US009114303B2

(12) United States Patent
Li et al.

(10) Patent No.: US 9,114,303 B2
(45) Date of Patent: Aug. 25, 2015

(54) FULL SWING GOLF EXERCISE APPARATUS

(76) Inventors: Hanwei Li, Guangzhou (CN); Jiancheng Li, Guangzhou (CN)

( * ) Notice: Subject to any disclaimer, the term of this patent is extended or adjusted under 35 U.S.C. 154(b) by 0 days.

(21) Appl. No.: 14/375,941

(22) PCT Filed: Aug. 8, 2012

(86) PCT No.: PCT/CN2012/079805

§ 371 (c)(1),
(2), (4) Date: Jul. 31, 2014

(87) PCT Pub. No.: WO2013/113216

PCT Pub. Date: Aug. 8, 2013

(65) Prior Publication Data

US 2014/0378241 A1 Dec. 25, 2014

(30) Foreign Application Priority Data

Feb. 2, 2012 (CN) ..... 2012 1 0023245

(51) Int. Cl.
*A63B 69/36* (2006.01)

(52) U.S. Cl.
CPC ..... *A63B 69/3644* (2013.01); *A63B 2210/50* (2013.01); *A63B 2225/09* (2013.01)

(58) Field of Classification Search
USPC ..... 473/226, 229, 257, 258, 259
See application file for complete search history.

(56) References Cited

U.S. PATENT DOCUMENTS

| | | | | |
|---|---|---|---|---|
| 2,756,056 | A * | 7/1956 | Zega | 473/259 |
| 2,868,543 | A * | 1/1959 | Zega | 473/259 |
| 3,489,416 | A * | 1/1970 | Mark | 473/229 |
| 5,895,327 | A * | 4/1999 | Francisco | 473/229 |
| 7,611,420 | B1 * | 11/2009 | Turner | 473/259 |

* cited by examiner

*Primary Examiner* — Nini Legesse
(74) *Attorney, Agent, or Firm* — Novoclaims Patent Services LLC; Mei Lin Wong

(57) ABSTRACT

A full swing golf exercise apparatus comprises a supporting rod (7). The supporting rod (7) is provided with a noncoplanner upper rod track rail (1) and lower rod track rail (2) with two ends thereof being joined correspondingly, wherein a stopping rod track rail (13) with a free end is provided on one of the joints.

17 Claims, 5 Drawing Sheets

FULL SWING GOLF EXERCISE APPARATUS

CROSS REFERENCE OF RELATED APPLICATION

This is a national phase national application of an international patent application number PCT/CN2012/079805 with a filing date of Aug. 8, 2012, which claimed priority of a foreign application number 201210023245.7 with a filing date of Feb. 2, 2012 in China. The contents of these specifications, including any intervening amendments thereto, are incorporated herein by reference.

BACKGROUND OF THE PRESENT INVENTION

1. Field of Invention

The present invention relates to a golf training equipment, and more particularly to a full swing training apparatus for golf.

2. Description of Related Arts

Golf swing is a basic and critical skill in golf. The precise form of swing will directly affect the trajectory of a golf ball and hence the result. Golf player will have a feeling that as long as the posture is correct, the result will not be too bad. Since a player at the beginning stage lacks a fixed form of proper swing action, in addition to other factors in this sports, the form of swing action will be altered easily. Accordingly, how to stabilize a form of proper swing action is a critical factor which directly affects the result in golf playing.

The action of swing looks simple but in fact includes many posture rules which must be followed. If any parts of the body does not follow the correct posture, not only the strength of batting is affected, but also the driving direction of the ball will be substantially deviated from the expected route. In the past, the inventor of golf training device has the view that: a standard swing action requires a co-planar alignment of trajectory of the clubhead throughout the whole process, which includes address setup, backswing, downswing, batting, delivering and stopping action, that is the swing plane. An ideal swing plane should be a plan formed by a line from the right shoulder (or left shoulder) of the player to the batting point and a target line. Accordingly, the trajectory of golf training devices in the conventional arts are all have a co-planar design for the trajectory track. For example, the Chinese utility model patent application number 200320100226.6, publication date Dec. 22, 2014, disclosed a golf swing practice device which includes a base frame; a curved track unit provided on the base frame; wherein a user location is defined at a rear position of the curved track unit for the trainee to stand and perform a swing action; wherein the trajectory of the curved track unit is positioned on the same plane; in addition, the Chinese utility model patent application 03277246.7, publication date Sep. 8, 2004, disclosed a swing practice device which includes a curved track unit defining a track plane and a length of the track plane is based on the maximum swing width of a club end of a golf club during a golf swing, and a position base for position the curved track unit under a preset angle condition for use, wherein the position base is provided at a bottom of the curved track unit, and according to the pictorial illustration, the curved track unit is positioned within one plane; in addition, an inventive patent application number 200680056595.6, publication date Dec. 9, 2009, disclosed a type of inflatable golf swing training device which includes an inflatable trajectory track unit, an adjustment support, wherein the inflatable trajectory track unit has an arc of trajectory which is a track for swing action, and is constructed by sealed capsule enclosure made by flexible hollow materials, and according to the pictorial illustration, the track unit is positioned within one plane.

Based on the photos captured by a high-speed photographical shooting of all golf swing of all professional golf player, a front view of the trajectory track shows that the arc center of a backswing and the arc center of a downswing are not positioned at the same point, a side view shows that the corresponding plane for the backswing and for the downswing are not at the same plane, while individual backswing and downswing are also not at the same plane, which are depicted in FIG. 1 and FIG. 2 of the drawings FIG. 1 is captured behind the trajectory path and illustrates the backswing and downswing to batting action of a player in which the numerical reference 100 refers to the trajectory path of a backswing and a downswing, and 101 refers to the player. FIG. 2 is captured at a higher position of vertical swing plane in which the numerical reference 103 refers to the the trajectory path of a backswing and a downswing, 102 refers to the actual position of left shoulder of the player. Based on the trajectory paths 100, 103 for backswing and downswing action in FIG. 1 and FIG. 2, the swing plane for backswing and for downswing are not co-planar in alignment. Accordingly, the existing golf training devices which provides a co-planar trajectory track for training fail to provide a fully simulated trajectory path. Thus, beginners who use the existing golf training devices cannot practice and form a proper swing action and cannot play well.

SUMMARY OF THE PRESENT INVENTION

An object of the present invention is to provide a full swing golf training apparatus in which the trajectory of a swing is not at a co-planar alignment.

In order to achieve the above object, the followings are employed:

The present invention provides a full swing training apparatus for golf training which comprises: a base support; a backswing trajectory track unit supported by the base support defining a connecting end; a downswing trajectory track unit supported by the base support defining a connecting end connected to the backswing trajectory track unit in a non-coplanar manner to define a joint portion; and a stopping trajectory track unit having a connecting end connecting to the backswing trajectory track unit and the downswing trajectory track unit at the joint portion and a free end.

A golf trainee perform the backswing action along the backswing trajectory track unit, through the open end of the backswing trajectory track unit and the connecting portion of the downswing trajectory track unit to transition to the downswing trajectory track unit to start the downswing action, then through the connecting portion at the other end of the backswing trajectory track unit and the downswing trajectory track unit to transition to the backswing trajectory track unit to continue the backswing action until the swing action practice is complete. The above swing action is repeated for practice purpose. Since the swing action is not in a co-planar alignment, the trajectory of a swing and batting action of a professional golf player is fully simulated, therefore a fixed form of proper swing action can be achieved through practice.

Full swing is a basic and critical skill in golf. The force of a swing comes from the swing and turning action of a body to drive the arm to provide an increased level of driving force for batting. Before a swing is performed, the player's stance is formed by the bending of different joints, and is also formed by different angles, which is the internal factor for the starting of a proper swing. The player's stance involves the joints of knees, hips, waist and vertebral to restrict movement to a specific bending angle, and the pivotal point of the turning control of the player should be at the coccyx, which is the main point for a proper swing and turning action. However, it is very difficult for a beginner player to control his or her body at this bending angle and to perform turning action at this pivotal point. The reason is that factors such as strength will affect the instinct of the player. More importantly, the swing action in golf is dependent on the turning action and loss of balance will be resulted during the turning action. The force of swing requires the specific angles and pivotal point in which the force initiates from the foot which is rotatably pushing upward to thighs, waist, shoulders and hands and through the centrifugal force being generated, the moving speed of the swing will be increased exponentially and the force of batting will be increased dramatically. In order to become a good player, swing and turning ability is the prerequisite requirement for golf. Accordingly, the above technical features can be improved as follows: the apparatus further comprises a swing angle control arrangement connected to the base support comprising a dial member, a guiding groove member positioned on the dial member and an angle measuring unit provided on the guiding groove member.

The golf trainee can use the angle measuring unit and the guiding groove member to set the angle and pivot when leaning against the apparatus, then through the rotational force of the dial member to drive the golf trainee for swing and turning action. The apparatus, by means of angle restriction for turning movement, is capable of aiding a proper swing action.

Since golf has 9 types of clubs, the face angles of different types of clubs are different and the side curvatures are therefore different. Therefore, the swing trajectory will be different. Additional factors such as the height and wingspan of each player will also affect the swing trajectory, therefore the trajectory for each player with each type of club will be different. Accordingly, the above technical features can be improved as follows: the backswing trajectory track unit defines an open end opposite to the connecting end of the backswing trajectory track unit and comprises a first adjustable rod member, the downswing trajectory track unit defines an open end opposite to the connecting end of the downswing trajectory track unit and comprises a second adjustable rod member, wherein the first and the second adjustable rod members are connected through a soft rod member, wherein the connecting end of the backswing trajectory track unit and the connecting end of the downswing trajectory track unit are connected in a moveable manner through a slot member and a latch member complement to the slot member.

The apparatus further comprises a first connecting member and a third connecting member on the backswing trajectory track unit and the stopping trajectory track unit respectively arranged for adjusting a rotation and folding angle of the corresponding track unit, and a second connecting member on the downswing trajectory track unit arranged for adjusting a rotation and folding angle of the downswing trajectory track unit. Each of the first, the second and the third connecting member comprises a pair of sleeve members, each having an engaging teeth; and a latch member for position locking operatively connected to one the sleeve member for restricting a position of the sleeve member, wherein the two engaging tooth of the pair of sleeve members are engaged with each other and a locking latch member is provided to lock the two engaging tooth of the sleeve members.

The stopping trajectory track unit comprises a guiding track member at the free end of the stopping trajectory track unit for guiding a movement of a golf club and a retention latch member locking the guiding track member into position; and a support track unit is provided on the base support arranged for maintaining a balance between the backswing trajectory track unit, the downswing trajectory track unit, the stopping trajectory track unit and the base support.

The base support comprises a base member comprising a fourth adjustable rod member and a base retention latch member on the fourth adjustable rod member for restricting a position of the fourth adjustable rod member, and a track support is provided between the base support and the backswing trajectory track unit, the downswing trajectory track unit and the stopping trajectory track unit, wherein the track support comprises a third adjustable rod member, a positioning rod member and a weight adjustment block on the positioning rod member, wherein the fourth adjustable rod member and the positioning rod member are locked into position by a base locking latch member.

Through the engagement of the engaging tooth of the first, second and third connecting members, adjustment of the rotation and folding angles of each of the corresponding track units can be achieved. Through a slot member and a latch member complement to the slot member on the backswing trajectory track unit and the downswing trajectory track unit for connection in a moveable manner, a distance between the backswing trajectory track unit and the downswing trajectory track unit and the angle between the planes of the corresponding track unit can be adjusted; through the first adjustable rod member and the second adjustable rod member, the length of the corresponding track unit can be adjusted; through the soft rod member between the first adjustable rod member and the second adjustable rod member, the trajectory for the transition from backswing to downswing can be simulated such that the action of trajectory is the same as that of the thumb and lower part of index finger grip portion of the hand grip on the golf club of a professional player. In addition, through the use of the base support and the track support, a height of the backswing trajectory track unit and the downswing trajectory track unit can be adjusted to fit different trainees of different body height and wingspan.

The present invention can fully simulate the trajectory of swing of a professional golf player for practice so as to ensure that when different players using different golf clubs to practice, the trajectory of the swing action during practice can still fully simulate the trajectory of a golf club of a professional player. Accordingly, the trainee can feel, learn and form a more ideal and proper swing action so as to increase the skill level in playing golf.

List of numeral references: 100—backswing and downswing trajectory track unit; 101—player; 102—actual position of the left shoulder of player; 103—backswing and downswing trajectory track unit; 104—golf trainee; 1—backswing trajectory track unit; 11—curved track segment; 12—first curvature adjustable track segment; 13—stopping trajectory track unit; 14—guiding track member; 15—latch member; 16—first adjustable rod member; 2—downswing trajectory track unit; 21—moving arc track segment; 22—second curvature adjustable track segment; 23—slot member; 24—second adjustable rod member; 3—first connecting member; 31—sleeve member; 311—engaging tooth; 32—sleeve member; 321—engaging tooth; 322—latch member for position locking; 33—locking latch member; 4—second connecting member; 5—third connecting member; 6—track support; 61—weight adjustment block; 62—third adjustable rod member; 63—positioning rod member; 7—base support; 71—fourth adjustable rod member; 72—base retention latch member; 73—base locking latch member; 74—base member; 8—soft rod member; 9—dial member; 10—angle measuring unit; 17—guiding groove member; 18—support track unit; 19—connecting rod.

DETAILED DESCRIPTION OF THE PREFERRED EMBODIMENT

The present invention is further described in details with the accompanying figures and embodiments.

Figure 1:
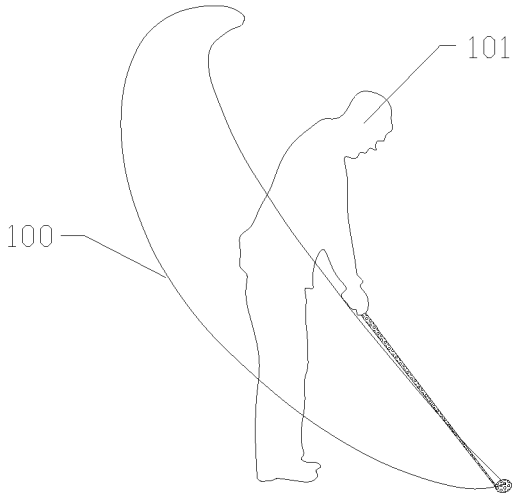
FIG. 1 is an illustration of the trajectory path of a swing trajectory of a professional golfer pictured from a rear position.
Figure 2:
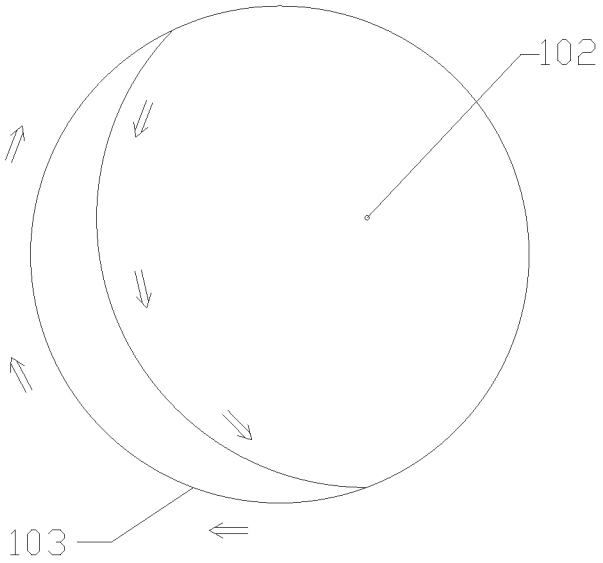
FIG. 2 an illustration of the trajectory path of a vertical swing plane of a professional golfer pictured from a top position.
Figure 3:
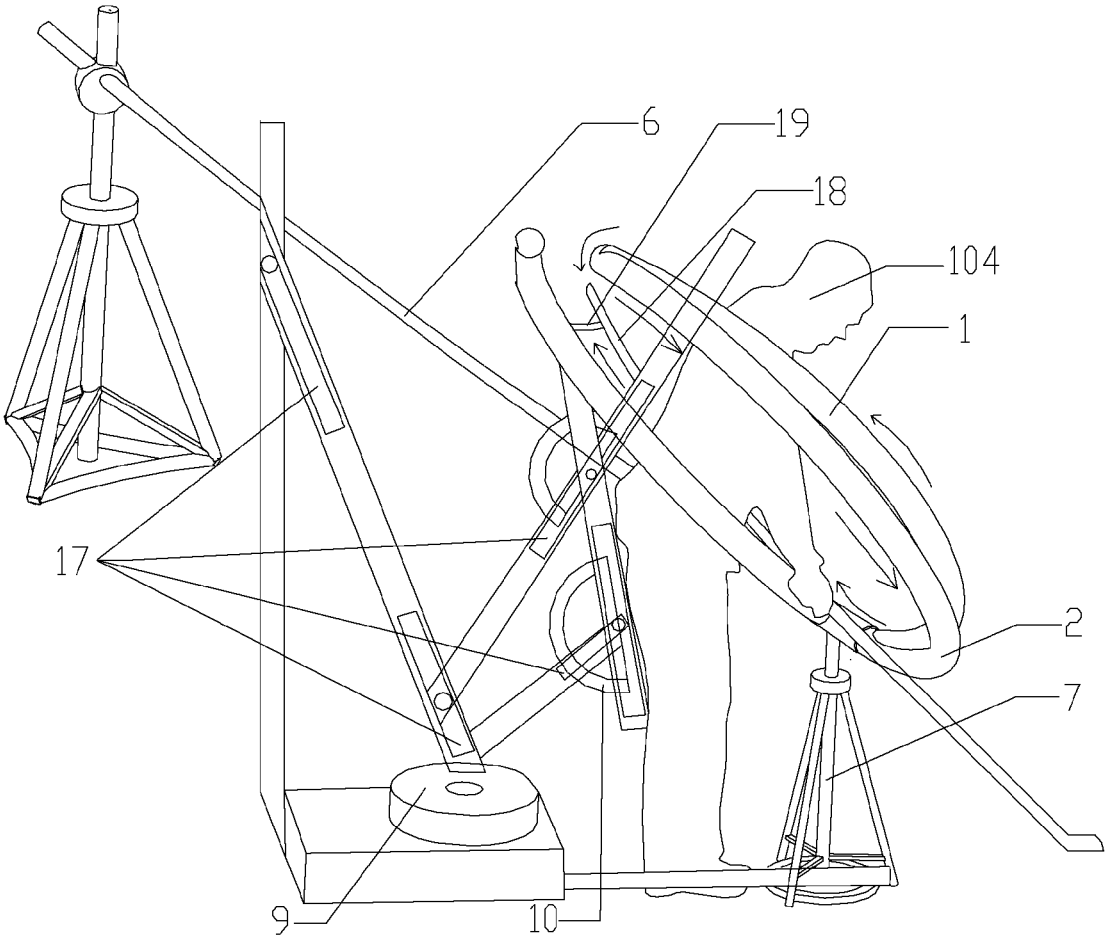
FIG. 3 is a structural illustration of the preferred embodiment of the present invention.

Referring FIG. 3 of the drawings, the present invention comprises two components, which are a swing device and a swing angle control arrangement. The swing device comprises a backswing trajectory track unit 1, a downswing trajectory track unit 2, a stopping trajectory track unit 13, a support track unit 18, a track support 6 and a base support 7. The support track unit 18 has a first end securely connected to the stopping trajectory track unit 13 through a connecting rod 19 and a second end, which is opposite to the first end, securely connected to the backswing trajectory track unit 1 and the downswing trajectory track unit 2. Accordingly, the balance of the backswing trajectory track unit 1, the downswing trajectory track unit 2, the stopping trajectory track unit 13 and the track support 6 during swing practice can be stabilized. The level of the track unit can be adjusted through the track support 6 and the base support 7. The swing angle control arrangement is an auxiliary arrangement for the swing device, which comprises: a dial member 9, an angle measuring unit 10 and a guiding groove member 11. When a golf trainee 104 stands between the swing device and the swing angle control arrangement during practice, a golf club is placed inside the track unit, the best leaning angle of the trainee is measured through the angle measuring unit 10, the dial member 9 is rotated to the best leaning pivot of the trainee, then swing action can be started for swing training.

Figure 4:
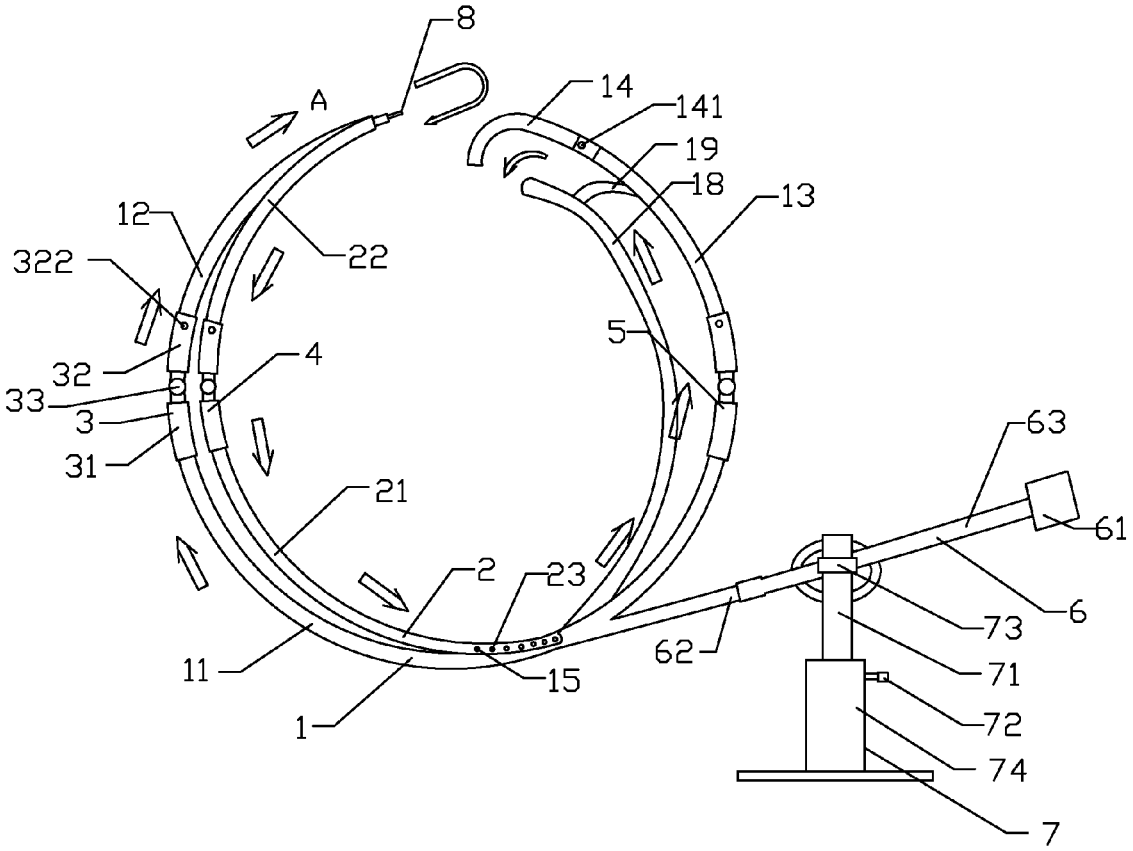
FIG. 4 is a structural illustration of a swing device of FIG. 3.
Figure 5:
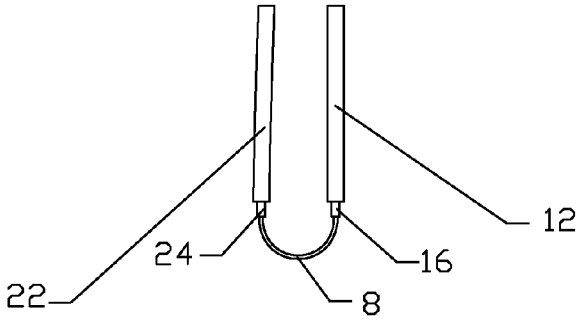
FIG. 5 is an illustration of the condition of joint portion of a soft rod member of FIG. 4.
Figure 6:
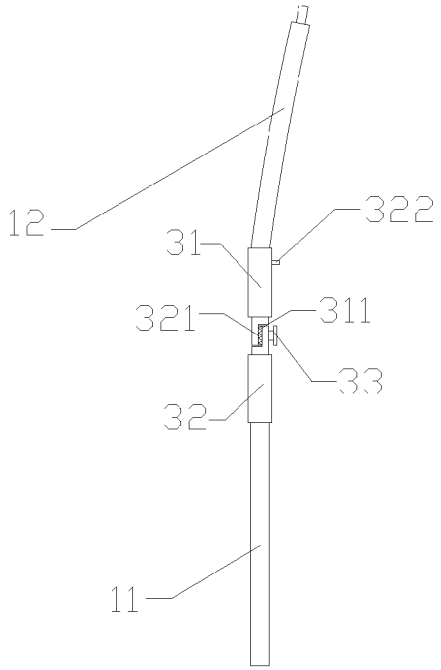
FIG. 6 is an illustration of the condition after adjustment of a first connecting member of FIG. 4.
Figure 7:
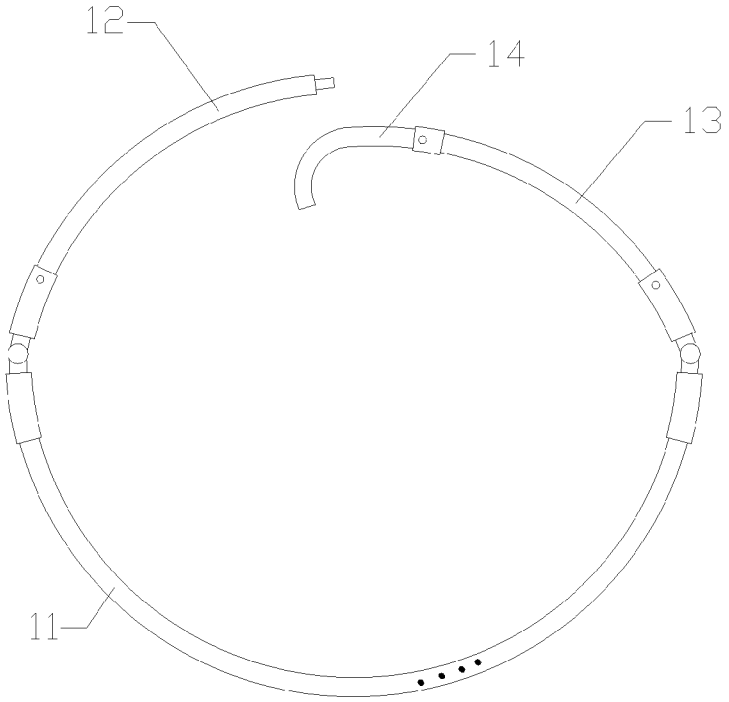
FIG. 7 is an illustration of the condition after adjustment of a backswing trajectory track unit and a stopping trajectory track unit of FIG. 4.
Figure 8:
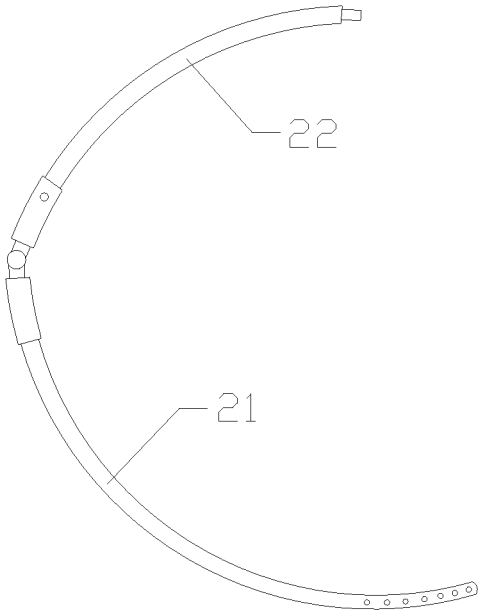
FIG. 8 is an illustration of the condition after adjustment of a downswing trajectory track unit of FIG. 4.

Referring to FIG. 4 of the drawings, the backswing trajectory track unit 1 of the swing device comprises a first curvature adjustable track segment 12, a curved track segment 11 with a fixed preset curvature, and a first connecting member 3 connecting the first curvature adjustable track segment 12 and the curved track segment 11. The downswing trajectory track unit 2 comprises a second curvature adjustable track segment 22, a moving arc track segment 21, and a second connecting member 4 connecting the second curvature adjustable track segment 22 and the moving arc track segment 21. The length of the backswing trajectory track unit 1 is greater than the length of the downswing trajectory track unit 2. The length of the curved track segment 11 is greater than the length of the first curvature adjustable track segment 12. The length of the moving arc track segment 21 is greater than the length of the second curvature adjustable track segment 22. The stopping trajectory track unit 13 further comprises a guiding track member 14 for guiding a movement of a golf club and a retention latch member 141 for fixing the position of the guiding track member 14. A slot member 23 and a latch member 15 which is complement to the slot member 23 are employed to moveably connect a bottom end of the moving arc track segment 21, a middle portion of the curved track segment 11 and the stopping trajectory track unit 13 together. Referring to FIG. 5 of the drawings, a first adjustable rod member 16 and a second adjustable rod member 24 are provided at the end portion of the first curvature adjustable track segment 12 and the second curvature adjustable track segment 22 respectively for adjusting a length of the corresponding track unit, while a soft rod member 8 is connected between the first adjustable rod member 16 and the second adjustable rod member 24, therefore a golf club moving along the backswing trajectory track unit 1 can have a smooth transition to the downswing trajectory track unit 2 through the soft rod member 8. Referring to FIG. 6 of the drawings, the first connecting member 3, the second connecting member 4, and the third connecting member 5 have the same mechanism for adjusting the angle of rotation and folding for the track unit in which each connecting member comprises two sleeve members 31, 32 having two engaging tooth 311, 312 respectively for forming a pair and a locking latch member 33 is employed for locking the pair of engaging tooth into position, that after bending between the first curvature adjustable track segment 12 and the curved track segment 11, and between the second curvature adjustable track segment 22 and the moving arc track segment 21, the locking latch member 33 is employed to lock into position for changing the rotation angle and folding angle of the corresponding track unit to fit the need of user with different body height and arm length. Meanwhile, through the use of a latch member for position locking 322, the sleeve member 31 can be restricted and locked into position. Referring to FIG. 7 of the drawings, the operational condition of the backswing trajectory track unit 1 and the stopping trajectory track unit 13 after adjustment through the first connecting member 3 and the third connecting member 5 is illustrated. Referring to FIG. 8 of the drawings, the operational condition of the downswing trajectory track unit 2 after adjustment through the second connecting member 4 is illustrated.

Referring to FIG. 4 of the drawings, the track support 6 comprises a third adjustable rod member 62 and a positioning rod member 63. The positioning rod member comprises weight adjustment block 61; the base support 7 comprises a base member 74, a base retention latch member 72, a fourth adjustable rod member 71 locking into position on the base member through the base retention latch member 72, and a base locking latch member 73 locking the fourth adjustable rod member 71 and the positioning rod member 63 into position.

Referring to FIG. 4 of the drawings, a golf club is guided to moved along the direction of the arrows in the figure during swing practice in which a backswing is guided through the backswing trajectory track unit 1, a downswing is guided through the downswing trajectory track unit 2, and the golf club is guided to the guiding track member 14 of the stopping trajectory track unit 13 to return to the initial position which corresponds to the ball position through the free end of the backswing trajectory track unit 1 for starting another cycle of swing movement.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A full swing golf training apparatus which comprises a base support, characterized in that, said apparatus comprises: a backswing trajectory track unit supported by said base support defining a connecting end; a downswing trajectory track unit supported by said base support defining a connecting end connected to said backswing trajectory track unit in a non-coplanar manner to define a joint portion; a stopping trajectory track unit having a connecting end connecting to said backswing trajectory track unit and said downswing trajectory track unit at said joint portion and a free end, a swing angle control arrangement connected to said base support comprising a dial member, a guiding groove member positioned on said dial member and an angle measuring unit provided on said guiding groove member.

2. The full swing golf training apparatus according to claim 1, characterized in that, said backswing trajectory track unit defines an open end opposite to said connecting end of said backswing trajectory track unit and comprises a first adjustable rod member, said downswing trajectory track unit defines an open end opposite to said connecting end of said downswing trajectory track unit and comprises a second adjustable rod member, wherein said first and said second adjustable rod members are connected through a soft rod member, wherein said connecting end of said backswing trajectory track unit and said connecting end of said downswing trajectory track unit are connected in a moveable manner through a slot member and a latch member complement to said slot member.

3. The full swing golf training apparatus according to claim 2, characterized in that, said apparatus comprising a first connecting member and a third connecting member on said backswing trajectory track unit and said stopping trajectory track unit respectively arranged for adjusting a rotation and folding angle of said corresponding track unit, and a second connecting member on said downswing trajectory track unit arranged for adjusting a rotation and folding angle of said downswing trajectory track unit.

4. The full swing golf training apparatus according to claim 3, characterized in that, each of said first, said second and said third connecting member comprises a pair of sleeve members, each having an engaging teeth; and a latch member for position locking operatively connected to one said sleeve member for restricting a position of said sleeve member, wherein said two engaging tooth of said pair of sleeve members are engaged with each other and a locking latch member is provided to lock said two engaging tooth of said sleeve members.

5. The full swing golf training apparatus according to claim 1, characterized in that, said base support comprises a base member comprising a fourth adjustable rod member and a base retention latch member on said fourth adjustable rod member for restricting a position of said fourth adjustable rod member, and a track support is provided between said base support and said backswing trajectory track unit, said downswing trajectory track unit and said stopping trajectory track unit, wherein said track support comprises a third adjustable rod member, a positioning rod member and a weight adjustment block on said positioning rod member, wherein said fourth adjustable rod member and said positioning rod member are locked into position by a base locking latch member.

6. A full swing golf training apparatus which comprises a base support, characterized in that, said apparatus comprises: a backswing trajectory track unit supported by said base support defining a connecting end; a downswing trajectory track unit supported by said base support defining a connecting end connected to said backswing trajectory track unit in a non-coplanar manner to define a joint portion; and a stopping trajectory track unit having a connecting end connecting to said backswing trajectory track unit and said downswing trajectory track unit at said joint portion and a free end, said backswing trajectory track unit defines an open end opposite to said connecting end of said backswing trajectory track unit and comprises a first adjustable rod member, said downswing trajectory track unit defines an open end opposite to said connecting end of said downswing trajectory track unit and comprises a second adjustable rod member, wherein said first and said second adjustable rod members are connected through a soft rod member, wherein said connecting end of said backswing trajectory track unit and said connecting end of said downswing trajectory track unit are connected in a moveable manner through a slot member and a latch member complement to said slot member.

7. The full swing golf training apparatus according to claim 6, characterized in that, said apparatus comprising a first connecting member and a third connecting member on said backswing trajectory track unit and said stopping trajectory track unit respectively arranged for adjusting a rotation and folding angle of said corresponding track unit, and a second connecting member on said downswing trajectory track unit arranged for adjusting a rotation and folding angle of said downswing trajectory track unit.

8. The full swing golf training apparatus according to claim 7, characterized in that, each of said first, said second and said third connecting member comprises a pair of sleeve members, each having an engaging teeth; and a latch member for position locking operatively connected to one said sleeve member for restricting a position of said sleeve member, wherein said two engaging tooth of said pair of sleeve members are engaged with each other and a locking latch member is provided to lock said two engaging tooth of said sleeve members.

9. The full swing golf training apparatus according to claim 6, characterized in that, said track support comprises a third adjustable rod member, a positioning rod member and a weight adjustment block on said positioning rod member, said base support comprises a base member, a fourth adjustable rod member and a base retention latch member on said fourth adjustable rod member for restricting a position of said fourth adjustable rod member, and a track support is provided between said base support and said backswing trajectory track unit, said downswing trajectory track unit and said stopping trajectory track unit, wherein said fourth adjustable rod member and said positioning rod member are locked into position by a base locking latch member.

10. A full swing golf training apparatus which comprises a base support, characterized in that, said apparatus comprises: a backswing trajectory track unit supported by said base support defining a connecting end; a downswing trajectory track unit supported by said base support defining a connecting end connected to said backswing trajectory track unit in a non-coplanar manner to define a joint portion; and a stopping trajectory track unit having a connecting end connecting to said backswing trajectory track unit and said downswing trajectory track unit at said joint portion and a free end, wherein said stopping trajectory track unit comprises a guiding track member at said free end of said stopping trajectory track unit for guiding a movement of a golf club and a retention latch member locking said guiding track member into position, said backswing trajectory track unit defines an open end opposite to said connecting end of said backswing trajectory track unit and comprises a first adjustable rod member, said downswing trajectory track unit defines an open end opposite to said connecting end of said downswing trajectory track unit and comprises a second adjustable rod member, wherein said first and said second adjustable rod members are connected through a soft rod member, wherein said connecting end of said backswing trajectory track unit and said connecting end of said downswing trajectory track unit are connected in a moveable manner through a slot member and a latch member complement to said slot member.

11. The full swing golf training apparatus according to claim 10, characterized in that, said apparatus comprising a first connecting member and a third connecting member on said backswing trajectory track unit and said stopping trajectory track unit respectively arranged for adjusting a rotation and folding angle of said corresponding track unit, and a second connecting member on said downswing trajectory track unit arranged for adjusting a rotation and folding angle of said downswing trajectory track unit.

12. The full swing golf training apparatus according to claim 11 characterized in that, each of said first, said second and said third connecting member comprises a pair of sleeve members, each having an engaging teeth; and a latch member for position locking operatively connected to one said sleeve member for restricting a position of said sleeve member, wherein said two engaging tooth of said pair of sleeve members are engaged with each other and a locking latch member is provided to lock said two engaging tooth of said sleeve members.

13. The full swing golf training apparatus according to claim 10, characterized in that, said apparatus comprises a swing angle control arrangement connected to said base support comprising a dial member, a guiding groove member positioned on said dial member and an angle measuring unit provided on said guiding groove member.

14. The full swing golf training apparatus according to claim 13, characterized in that, said apparatus comprising a first connecting member and a third connecting member on said backswing trajectory track unit and said stopping trajectory track unit respectively arranged for adjusting a rotation and folding angle of said corresponding track unit, and a second connecting member on said downswing trajectory track unit arranged for adjusting a rotation and folding angle of said downswing trajectory track unit.

15. The full swing golf training apparatus according to claim 14, characterized in that, each of said first, said second and said third connecting member comprises a pair of sleeve members, each having an engaging teeth; and a latch member for position locking operatively connected to one said sleeve member for restricting a position of said sleeve member, wherein said two engaging tooth of said pair of sleeve members are engaged with each other and a locking latch member is provided to lock said two engaging tooth of said sleeve members.

16. The full swing golf training apparatus according to claim 13, characterized in that, said base support comprises a base member comprising a fourth adjustable rod member and a base retention latch member on said fourth adjustable rod member for restricting a position of said fourth adjustable rod member, and a track support is provided between said base support and said backswing trajectory track unit, said downswing trajectory track unit and said stopping trajectory track unit, wherein said track support comprises a third adjustable rod member, a positioning rod member and a weight adjustment block on said positioning rod member, wherein said fourth adjustable rod member and said positioning rod member are locked into position by a base locking latch member.

17. The full swing golf training apparatus according to claim 10, characterized in that, said track support comprises a third adjustable rod member, a positioning rod member and a weight adjustment block on said positioning rod member, said base support comprises a base member comprising a fourth adjustable rod member and a base retention latch member on said fourth adjustable rod member for restricting a position of said fourth adjustable rod member, and a track support is provided between said base support and said backswing trajectory track unit, said downswing trajectory track unit and said stopping trajectory track unit, wherein said fourth adjustable rod member and said positioning rod member are locked into position by a base locking latch member.

* * * * *